US009021833B2

(12) United States Patent
Arjang et al.

(10) Patent No.: US 9,021,833 B2
(45) Date of Patent: May 5, 2015

(54) JEWELRY ASSEMBLY WITH A REPLACEABLE DECORATIVE INSERT

(75) Inventors: Kourosh Arjang, Great Neck, NY (US); Edi Arjang, Great Neck, NY (US)

(73) Assignee: Arjang & Co., Great Neck, NY (US)

( * ) Notice: Subject to any disclaimer, the term of this patent is extended or adjusted under 35 U.S.C. 154(b) by 214 days.

(21) Appl. No.: 13/597,560

(22) Filed: Aug. 29, 2012

(65) Prior Publication Data

US 2013/0160489 A1 Jun. 27, 2013

Related U.S. Application Data

(60) Provisional application No. 61/578,323, filed on Dec. 21, 2011.

(51) Int. Cl.
*A44C 17/02* (2006.01)

(52) U.S. Cl.
CPC ..... *A44C 17/0208* (2013.01); *A44D 2203/00* (2013.01)

(58) Field of Classification Search
CPC .... A44C 17/0208; A44C 13/00; A44C 17/02; A44C 17/04; A44C 17/216
USPC ..... 63/12, 3, 900; 24/303
See application file for complete search history.

(56) References Cited

U.S. PATENT DOCUMENTS

| | | | |
|---|---|---|---|
| 2,615,227 | A | 10/1952 | Hornik |
| 4,796,442 | A | 1/1989 | Sarcona |
| 5,456,095 | A | 10/1995 | Tawil et al. |
| 5,588,310 | A | 12/1996 | Lai |
| 6,427,487 | B1 | 8/2002 | Morgan |
| 6,594,871 | B2 | 7/2003 | Hoffman |
| 6,715,314 | B2 | 4/2004 | Rose |
| 6,907,753 | B2 | 6/2005 | Lieberman |
| 7,201,021 | B2 | 4/2007 | Hartgrove |
| 7,409,837 | B2 | 8/2008 | Smith |
| 2002/0139142 | A1 | 10/2002 | Marandola, Jr. |
| 2004/0154143 | A1 | 8/2004 | Harrell |
| 2010/0192631 | A1 | 8/2010 | Richmond |

*Primary Examiner* — Jack W Lavinder
(74) *Attorney, Agent, or Firm* — Gottlieb, Rackman & Reisman P.C.

(57) ABSTRACT

A jewelry assembly includes a housing with a head having a well and an insert with a decorative surface and sized and shaped to fit into the well. Magnetic elements are provided to hold the insert and the head together so that insert can be replaced at will by a user with another insert that fits in the well but has a different decorative surface. Optionally, a tool is further provided to separate the insert from the head.

10 Claims, 6 Drawing Sheets

22
24
20
12
12
16

24
22
20
12
10
16
14
24
22
20
32

12
12
16

FIG. 4A
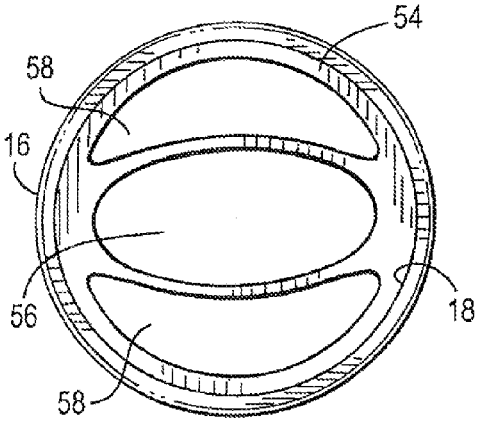
FIG. 4B
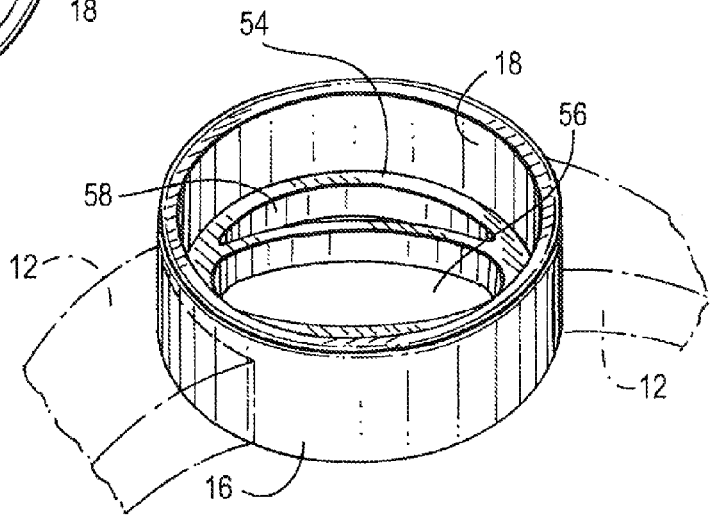
FIG. 5A
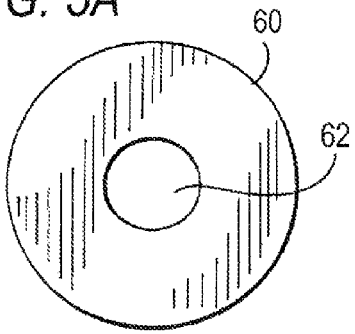
FIG. 4C
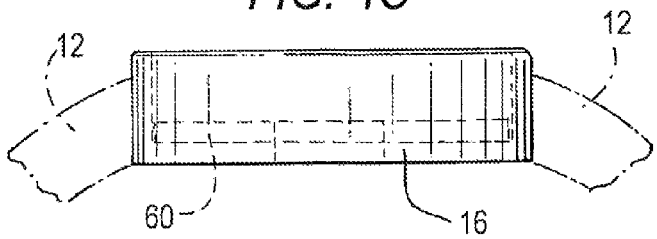
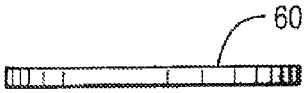
FIG. 5B
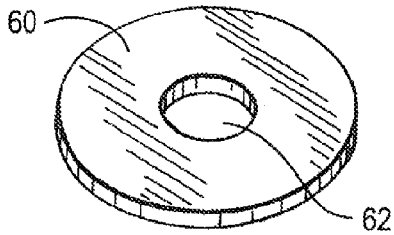
FIG. 5C FIG. 6A
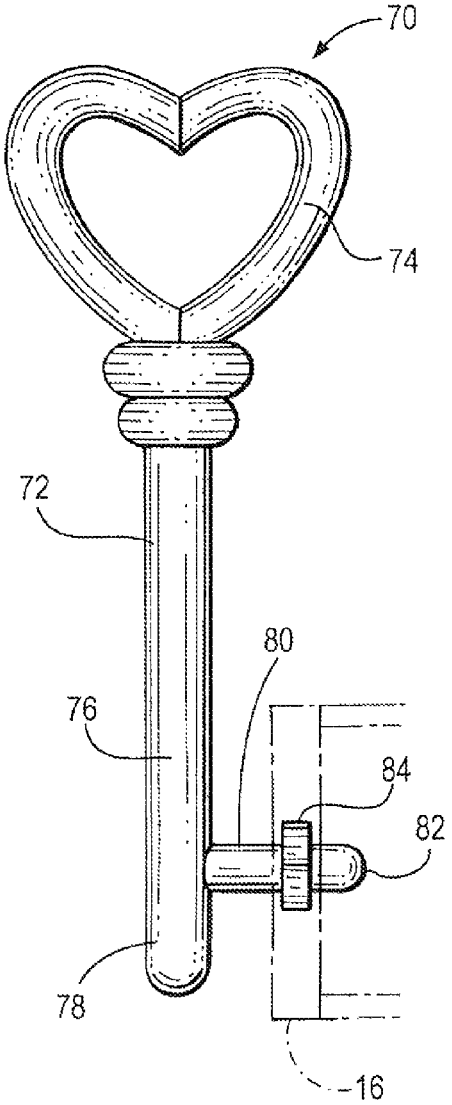
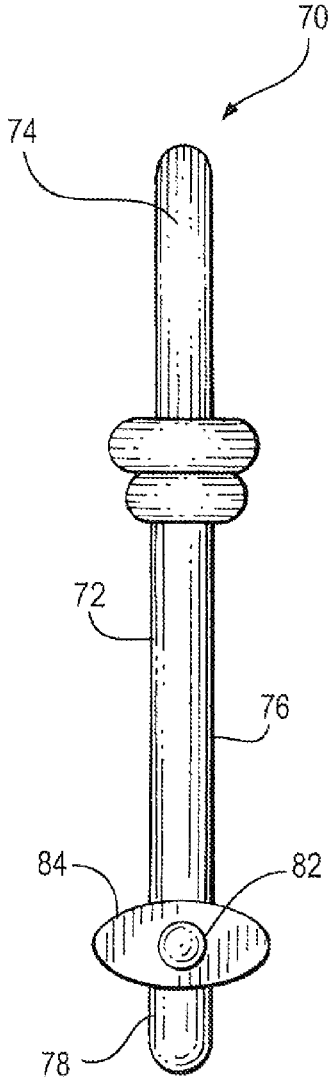
FIG. 6B FIG. 7A
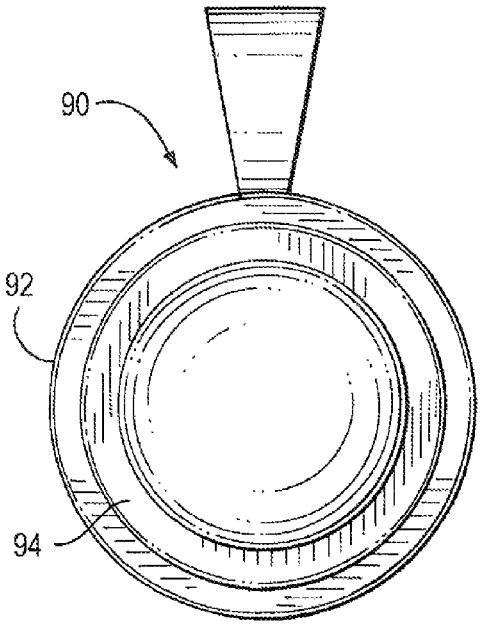
FIG. 7B
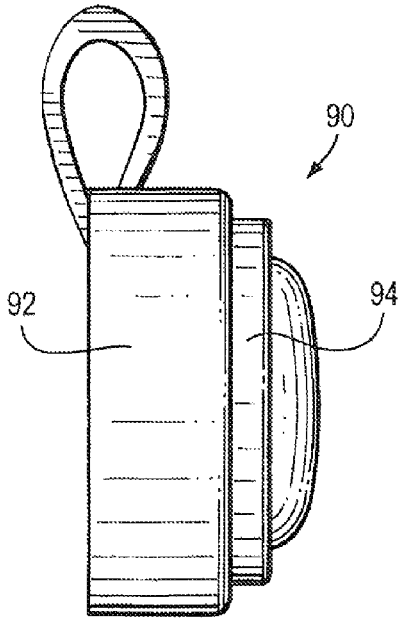
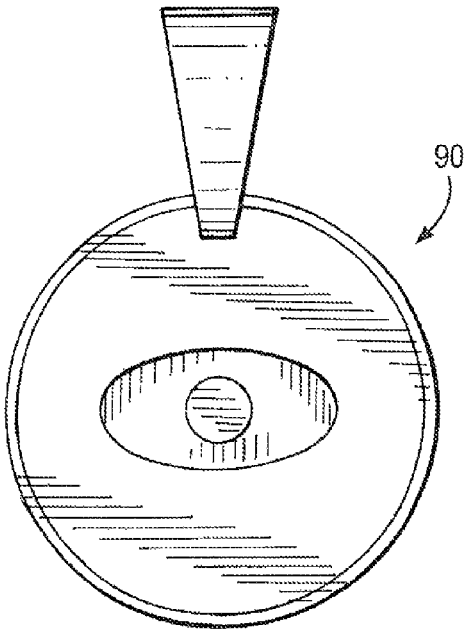
FIG. 7C

JEWELRY ASSEMBLY WITH A REPLACEABLE DECORATIVE INSERT

RELATED APPLICATIONS

This application claims priority to U.S. Provisional application Ser. No. 61/578,323 filed on Dec. 21, 2011 and incorporated herein in its entirety.

BACKGROUND OF THE INVENTION

1. Field of Invention

This invention pertains to a jewelry assembly formed of a housing with a cavity and one or more replaceable decorative inserts sized and shaped to fit snuggly into the housing. Magnetic elements are provided to keep and hold the inserts in the cavity.

2. Description of the Prior Art

Many different kinds of jewelry are formed of two components: a housing and an insert mounted in the housing. The housing is usually made of a precious metal, such as an alloy of gold, silver, platinum, etc., and the insert may be made of many different materials, including metal alloys, plastics, ceramics or even precious or semi-precious stone. Both components have decorative designs, sometimes having very complex shapes. Conventionally the insert is permanently attached to the housing and the housing is sized and shaped to be worn either directly on a person's body, or attached to clothing.

Many users, however, would find it advantageous if the inserts would be exchangeable between different pieces of jewelry because such an arrangement would give them more flexibility. For example, a jewelry piece with one colored stone would be suitable with one outfit while the same jewelry piece with a different colored stone would be suitable for another outfit.

While many attempts have been made to make such multi-piece jewelry, none of these attempts were successful.

SUMMARY OF THE INVENTION

A jewelry piece constructed in accordance with this invention includes a housing having a head including a well with a circular shape defining an axis extending through said head. An insert having a top surface with a decorative element and a sleeve extending below said top surface, said sleeve being shaped to fit in said well, said sleeve being rotatable around said axis within said well. A magnetic mounting member is arranged and constructed to hold said sleeve within said well. In one embodiment the head includes a head washer disposed in the well and the insert includes an insert washer disposed in said insert. One of said washers may be a magnet and the other of the washers may be made of a magnetizable material cooperating with said magnet to hold said insert and said head together. Alternatively both washers are magnets cooperating to hold said insert and said head together.

Preferably one of said insert and said head is formed with a boss extending along said axis, said boss extending into a hole to facilitate the rotation of said insert with respect to said head. In one embodiment, the boss extends through said head and is sized and shaped so that pushing said boss allows said insert and said head to separate from each other.

In one embodiment, a jewelry assembly is provided including a plurality of housings, each housing being formed with well with a bottom hole, the wells of all housings being substantially identical; a plurality of inserts, each insert including a top surface with a decorative element and a member extending to said bottom hole when a respective insert is seated in the well of a respective housing. Each housing and insert including a respective element to maintain the respective insert in the well of the respective housing when so seated. A tool is also provided having a separation member, said tool being shaped to allow said insertion member to be inserted through said hole to push on said member of the respective insert to separate the respective insert from the respective well.

BRIEF DESCRIPTION OF THE DRAWINGS

FIGS. 4A, 4B and 4C show a top, a perspective and side view of a head for the jewelry piece of FIGS. 1A-1F;

FIGS. 5A, 5B and 5C show a top, perspective and side view of a magnetic washer for the head for the jewelry piece;

FIGS. 6A and 6B show a plan and side views of a tool for removing the insert from the housing of FIGS. 1A-1F; and FIGS. 7A, 7B and 7C show an earring constructed in accordance with this invention.

DETAILED DESCRIPTION OF THE INVENTION

Figures 1A, 1B, 1C:
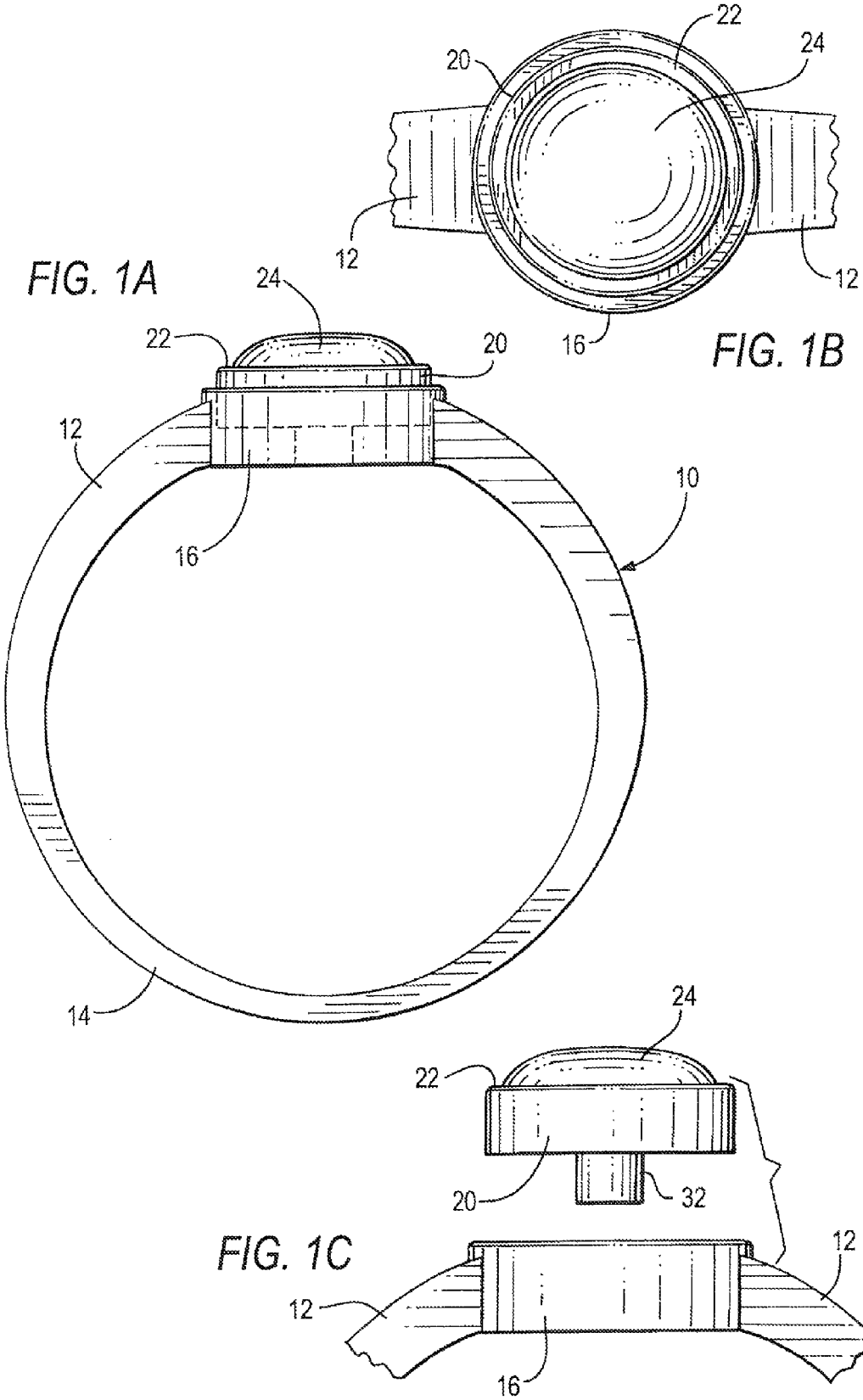
FIG. 1A shows a front view of jewelry piece constructed in accordance with this invention.
FIG. 1B is a top view of the piece of FIG. 1A.
FIG. 1C is an exploded side view of the piece of FIG. 1A.
Figure 1D:
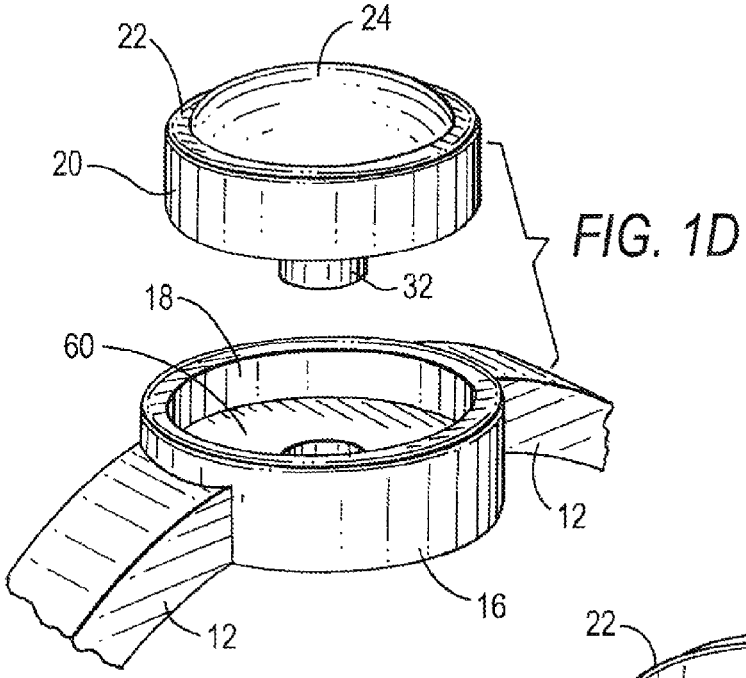
FIGS. 1D and 1E are top and bottom perspective exploded views of the piece of FIG. 1A, respectively.
Figure 1E:
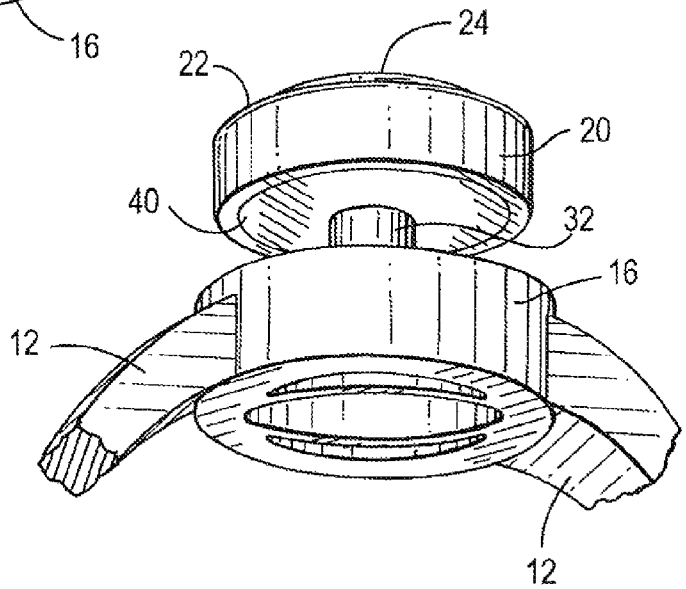

Referring now to the Figures, FIG. 1A-1F shows a ring 10 constructed in accordance with this invention. The ring 10 includes a housing 12 with a hoop-shaped shank 14 and a head 16. The head is formed with a well or cavity 18 receiving an insert 20. The insert 20 includes an insert sleeve 22 with a decorative member 24. It should be understood that for the sake of clarity member 24 is shown as being homogenous. However, it may consists of several segments, each segment having a different shape, size, color, or material and each segment may include one or more precious or semiprecious stones or other combined decorative members. Alternatively, various materials, such as colored glass, plastic and other metal alloys may be used to make the decorative element 24 is permanently mounted in sleeve 22.

Figure 1F:
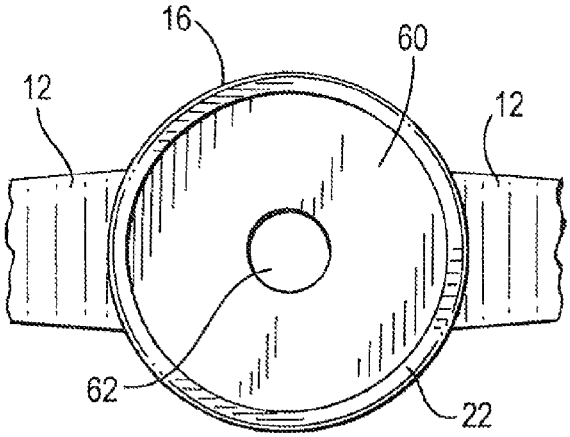
FIG. 1F shows a top view of the piece of FIG. 1A without the insert.

As shown in FIGS. 1C and 1F, the insert 20 is formed on the bottom with a cylindrical cavity 30 and an axially extending boss 32. A washer 40 is provided inside the cavity 30, disposed concentrically around boss 32. The insert 20 is sized and shaped so that the boss 32 extends downwardly passed the bottom edge of sleeve 22 as seen in FIG. 1C.

The well 18 in head is preferably cylindrical as well and its diameter is equal or just slightly larger than the outer diameter of sleeve 22. The well 18 is sized and shaped to receive the sleeve 22 of insert 20 snugly so that the sleeve 22 is not normally visible, as seen in FIG. 1A. The well 18 and the sleeve 22 may also have other shapes as well. For example, they may be frustoconical. They may have other geometric or irregular shapes however in this latter instance, the insert is not rotatable within the well.

Figure 2A:
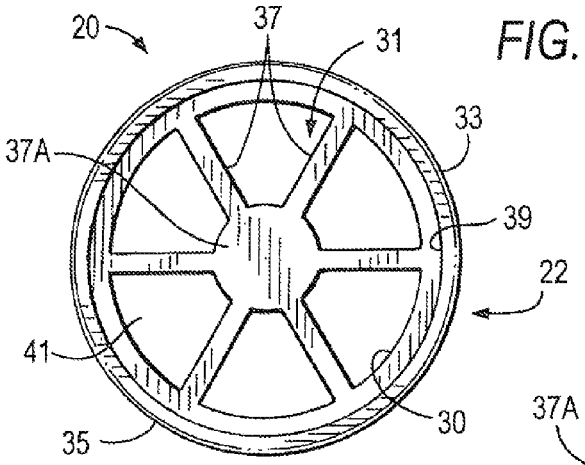
FIGS. 2A, 2B and 2C show a top, perspective side view of an insert in which the decorative stone has been removed for the sake of clarity for the jewelry piece of FIGS. 1A-1F.
Figure 2B:
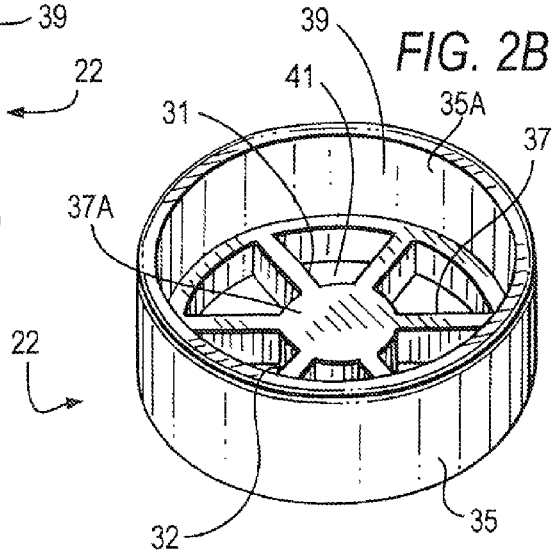
Figure 2C:
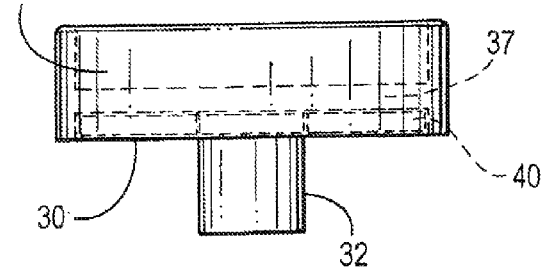
Figure 3A:
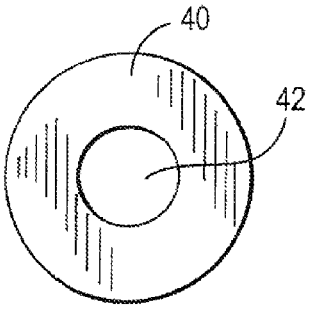
FIGS. 3A, 3B and 3C show a top, perspective and side view of a magnetic washer for the insert of FIGS. 2A-2C for the jewelry piece.
Figure 3B:
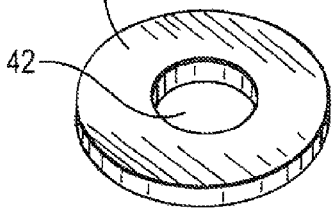
Figure 3C:
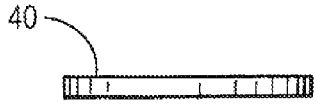

Details of the elements of the insert 20 are shown in FIGS. 2A-2C and 3A, 3C. The insert 20 includes a wheel shaped body 31 having a rim 33 with outer cylindrical wall 35 and a web 37 with a central coaxial portion 37A. An upper cavity or depression 39 is formed between the web 37 the inner surface of the rim 31. This upper cavity holds the stone 24. A second cavity 30 is defined by the web 37 and the bottom portion of the rim 33. A boss 32 is attached to the bottom wall of the central portion 37A and extends coaxially downwardly past the sidewall 35 as seen in FIG. 2C. A plurality of radial openings 41 are provided to make the insert lighter.

Insert 20 further includes a disc shaped washer 40 that is received into the second cavity 30. The washer is formed with a central concentric hole 42 having a diameter selected to allow the boss 32 to pass through the washer 40. The washer 40 can be secured to the body 31 by using an adhesive or other well-known means. Alternatively, the washer is made an integral part of the body 31.

Similarly, the head 16 is provided with a bottom wall 54 having at least a central opening 56 as shown in FIGS. 4A and 4B. In addition, the bottom wall 54 may also be provided with additional openings 58 for decorative purposes and/or to make the head 16 lighter. Preferably, the central opening 56 is oval and it is large enough to receive the boss 32 and plate 84 as discussed in more detail in conjunction with FIGS. 6A and 6B below. (in FIGS. 2A-2B, 4A, 4B the shank 14 of the ring is omitted for the sake of clarity.)

Nested in the well 18 is a washer 60 shown in FIGS. 5A-5C. The washer 60 has an axial opening 62 that is larger than the diameter of boss 32. The washer 60 is dimensioned so that it fits snuggly in the well 18 and is secured thereto by a suitable adhesive (not shown) or other similar means. Alternatively, both washers 40 and 60 have the same diameter as cavity 30 and well 18, respectively, or, are slightly larger and they are press fit into the insert 20 and head 16, respectively.

Importantly, in one embodiment of the invention, both washers 40 and 60 are made of a magnetic material. Preferably, they are made, or include, a rare earth-type magnetic material that generates a very strong magnetic field. Moreover, in the configuration shown in FIGS. 1C, 1D, 1E the magnetic washers are oriented in the same direction (e.g., N/S, N/S or S/N. S/N) so that they attract each other.

As shown in the Figures, the jewelry piece 10 is assembled by placing the insert 20 into the head 16 so that its sleeve 22 is nested completely inside the well 18. Preferably the head 16 and insert 20 is sized and shaped so that the two magnetic washers 40, 60 touch each other. Moreover, the boss 32 passes through both washers. Preferably, the boss 32 is made of a material that increases the strength of the magnetic field generated by the two washers. As a result, a very strong attractive force is generated between the head 16 and the insert 20 that insures that, once installed, the insert 20 does not easily separate and fall out of the head 16.

In an alternate embodiment of the invention, only one of the washers 40, 60 is made of a magnetic material and the other is made of a magnetizable material (e.g., a material that is attracted to magnet). If washer 40 is magnetic than washer 60 can be made integral with the head 16. If washer 60 is magnetic, washer 40 can be made integral with insert 20 and/or boss 32.

The boss 32 provides three distinct features for the jewelry piece 10. First, as discussed above, it strengthens the magnetic field between the washers 40, 60 and therefore increases the magnetic attractive force between them. Therefore, the washers 40, 60 could be made smaller and lighter than without the boss 32 and still be able to generate a strong magnetic field to hold the insert and the head together and prevent them from separating even while a wearer is involved in various strenuous physical activity, such as running, jumping, dancing, etc.

Second, the boss 32 is disposed concentrically in hole 62 and because both the well 18 and the sleeve 22 are round and concentrically oriented and spaced with respect to boss 32, the boss 32 acts as an axis of rotation allowing the insert 20 to rotate with respect the head 16. Preferably the head 16 and/or stone 24 can be designed with various decorative features that are enhanced by the positioning the insert 20 at one of several angles around the axis of boss 32. The boss 32 in this case facilitates the rotation of the insert with the respect to the head by maintaining the sleeve concentric with respect to the inside wall of the well. Without the boss, there may be a tendency on the part of the user to rotate the insert in a manner that would bring the sleeve in contact with the wall of the well thereby causing friction therebetween and making it harder to rotate the insert in the head and causing damage to the wells and in time losing the shape and not be able to it in to each other anymore.

Third, the boss 32 facilitates the removal of insert 20 from head 16 as described below.

As can be seen from the drawings, the insert is sized and shaped so that it fits into the well of the head with its wall 33 being flush with the inner wall of the well. As a result, and, especially because of the strong magnetic force between the washers 40, 60, insert 20 is almost impossible to separate from the head by hand. The insert 20 can be separated from the head 16 with some sharp object being pushed through the holes of the bottom wall 54. However, the boss 32 is preferably made long enough so that it penetrates and extends at least partially through hole 56 in the bottom wall 54. Then the insert 20 is easily separated from the head 16 by pushing the boss 32 axially. This action can again be performed, again by using a sharp object. However, in an alternate embodiment, a tool is provided for this purpose. Referring to FIGS. 6A and 6B, a tool 70 constructed in accordance with this embodiment includes a key-shaped body 72, including a head 74 attached to a blade 76. The head 74 can have any desired shape. Since the tool 70 is used with a highly decorative article, e.g., piece of jewelry 10, the whole key and its head may have decorative shape size, and color to make them attractive to users.

The shaft 76 has a tip 78 and may have a circular cross section. An arm 80 branches off from the shaft 76, preferably at a predetermined distance from the end of tip 78. Arm 80 may have a circular cross section and a diameter approximately equal to the diameter of boss 32. The arm 80 terminates with a tip 82 and set back from this tip 82 is a plate 84. The plate 84 is disposed in a plane perpendicular to the axis of arm 80 and has a generally oval shape as seen in FIG. 6B. The plate 84 is sized and shaped so that it fits into the hole 56.

The tool 70 is used to as follows. The shaft 76 is inserted through the shank 14 with the tip 78 being positioned under the head 16. The arm 80 is then advanced toward the head 16 until the tip 82 comes into contact with the boss 32. The arm 80 is then pushed longitudinally until the plate 84 enters and gets into opening 56 thereby displacing and pushing boss 32 axially outwardly of the well 18. At the same time the two washers 40, 60 are separated thereby reducing the magnetic force between these members considerably. As a result, the insert 20 can now be readily removed by hand from the head 16.

The tool 70 can be either given away to costumers as a promotional item, or sold to customers separately. However, advantageously, the tool 70, the housing 12 and the insert 20 are made with decorative elements that are either follow the same or similar theme (e.g., the same color, the same color combination, the same motif, etc.) or they complement each other. These three elements, or several combinations of elements, e.g., several housings 12, several inserts 20 and, optionally a tool 70) can be packaged and sold together as a jewelry assembly, with various inserts 20 being selectively inserted into various housings and then being removed at will with tool 70.

While the invention was described for a ring, obviously it is extendible to other types of jewelry as well, such as earrings, pins, necklace pendants, cuff-links, tie pins, etc. For example, FIGS. 7A-7C show an earring 90 having a head 92 and an insert 94 with the same characteristics as the corresponding components in FIGS. 1-5 that are joined by magnetic washers and selectively separated using the tool 70.

The jewelry assembly discussed above, can include the same type of housings or they can include several different types of housing forming rings, earrings, etc, with respective inserts.

Numerous other modifications may be made to the invention without departing from its scope as defined in the appended claims.

We claim:

1. A jewelry piece and a tool assembly comprising:

a housing with a head including a well with a bottom wall, a first hole, said housing further including a head washer disposed on said bottom wall and being formed with a second hole disposed axially with respect to said first hole; and an insert having a top surface with a decorative element attached to said insert and a sleeve extending below said top surface, said sleeve being shaped to fit in said well, said sleeve having a bottom surface with a boss extending downwardly;

at least one of said insert and housing magnetic and the other of said insert and said housing being one of a magnetic and magnetizable, thereby attracting each other by a magnetic force in order to releasably hold said insert attached to said housing;

wherein said insert and said head are constructed with said boss extending at least partially into said first hole when said insert is seated in said well and held by the magnetic force;

said insert and said head being separated by a tool having a tip and a plate, with said tool being positioned with the tip extending into said first hole to push against the boss and with the plate being sized and shaped to fit into said first hole.

2. The jewelry piece of claim 1 wherein said sleeve and well are circular and are arranged to rotate with respect to each other.

3. The jewelry assembly of claim 1 wherein said insert and said housing are magnetic.

4. The jewelry assembly of claim 1 wherein said first hole has a cross sectional shape matching a size and shape of the plate, said head and insert being separated when said tip is inserted into said second hole and said plate enters into the first hole.

5. The jewelry assembly of claim 1 wherein said second hole is circular and said first hole is oval.

6. The jewelry assembly of claim 1 wherein said insert is rotatably about a vertical axis passing through said boss when said insert is disposed in said well.

7. A jewelry piece comprising:

a housing with a head having a well and a bottom wall with a first hole said head further including a head washer including a second hole disposed coaxially with said first hole;

an insert having a top surface with a decorative element and a boss extending through said second hole when said insert is seated in said well; and a magnetic member arranged to hold said head and insert together by applying a magnetic force therebetween;

said boss being constructed to separate said head and insert and overcome said magnetic force when pushed out of said second hole by a key having a tip and a plate with said tip fitting into said second hole and the plate fitting into said first hole.

8. The jewelry piece of claim 7 wherein said head washer is disposed in said well above said first hole and said magnetic member is an insert washer disposed in said insert, one of said washers being made of a magnetic material and the other of said washers being made of one of a magnetic and a magnetizable material, said washers cooperating to generate a magnetic force to hold said head and insert together until separated.

9. A jewelry kit comprising:

a plurality of housings, each housing being formed with a well having a bottom wall, said bottom wall having a first hole, each well further including a second hole disposed above said first hole, the wells of all housings being substantially identical;

a plurality of inserts, each insert including a top surface with a decorative element and a member extending into said second hole when a respective insert is seated in the well of a respective housing; each said housing and insert having one of a magnetic and a magnetizable portion arranged and constructed to generate magnetic force between the respective insert and the head to maintain the respective insert in the well of the respective housing when so seated; and a tool having a separation member including a plate and a tip extending perpendicularly from said plate, said plate having a plate shape that is complementary to the shape of said first hole and said tip being arranged to enter into said second hole when said plate is disposed in said first hole, said tip being configured to push said member out of said first hole and to separate the respective insert from the respective housing when said tip is inserted through said first hole.

10. The jewelry kit of claim 9 wherein said tool includes a shaft and an arm, said arm extending perpendicularly from said shaft and supporting said plate and terminating with said tip.

* * * * *